United States Patent [19]

Weigl

[11] 3,972,718

[45] Aug. 3, 1976

[54] ELECTROSTATOGRAPHIC GRAVURE MEMBER

[75] Inventor: John W. Weigl, West Webster, N.Y.

[73] Assignee: Xerox Corporation, Stamford, Conn.

[22] Filed: May 19, 1975

[21] Appl. No.: 578,569

[52] U.S. Cl. ..... 96/1.5; 96/1 R; 96/1 LY; 252/501; 101/DIG. 13; 96/1.4; 427/16

[51] Int. Cl.[2] ..... G03G 5/06; G03G 5/08

[58] Field of Search ..... 96/1.5, 1.8; 252/501

[56] References Cited

UNITED STATES PATENTS

| | | | |
|---|---|---|---|
| 2,598,732 | 6/1952 | Walkup | 96/1.5 |
| 2,599,542 | 6/1952 | Carlson | 96/1.5 |
| 3,190,199 | 6/1965 | Clark | 96/1.5 X |
| 3,559,570 | 2/1971 | Martel et al. | 96/1 R X |
| 3,694,200 | 9/1972 | Pressman | 96/1.5 X |
| 3,717,459 | 2/1973 | McClure | 96/1.5 X |
| 3,801,315 | 4/1974 | Gundlach et al. | 96/1.4 |
| 3,832,297 | 8/1974 | Paul | 96/1.5 X |

FOREIGN PATENTS OR APPLICATIONS

| | | | |
|---|---|---|---|
| 1,472,923 | 2/1969 | Germany | 96/1.5 |
| 153,276 | 5/1963 | U.S.S.R. | 96/1.5 |

*Primary Examiner*—Roland E. Martin, Jr.
*Attorney, Agent, or Firm*—James J. Ralebate; James P. O'Sullivan; Jerome L. Jeffers

[57] ABSTRACT

Disclosed is a photosensitive device for use in electrostatographic copying. The device comprises:

a. an endless, arcuate substrate; and b. a thin, conductive filament having a layer on its surface of a photoconductive insulating material wrapped in helical configuration around said substrate. The filament is connected to ground or to a suitable bias source. In one embodiment of the invention, the filament layer is overcoated with a thin layer of an insulating organic resin to provide a device with a dielectric storage layer on its exposed surface. In another embodiment, the overcoating is not applied thereby providing an electrostatographic gravure member suitable for use with certain liquid developed imaging techniques.

14 Claims, 3 Drawing Figures

FIG. 1
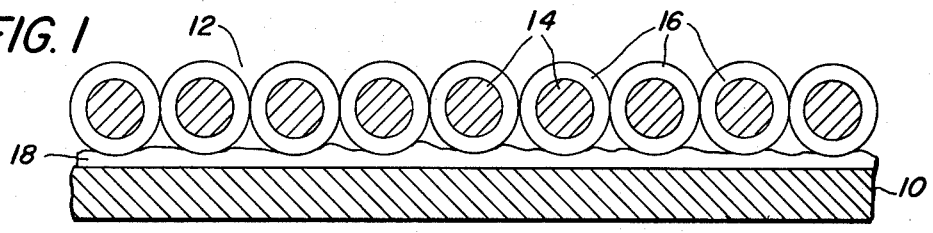
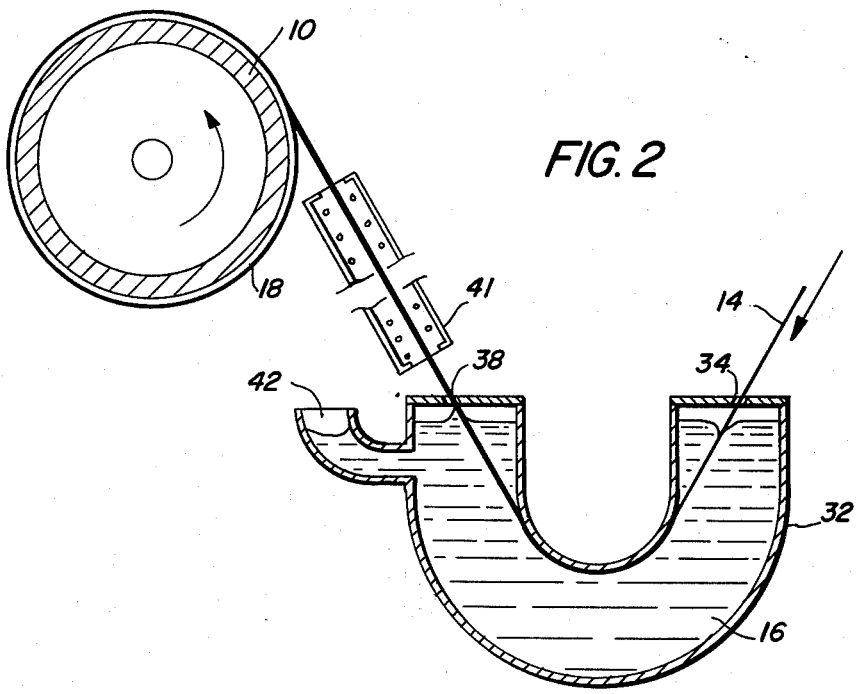
FIG. 2
FIG. 3
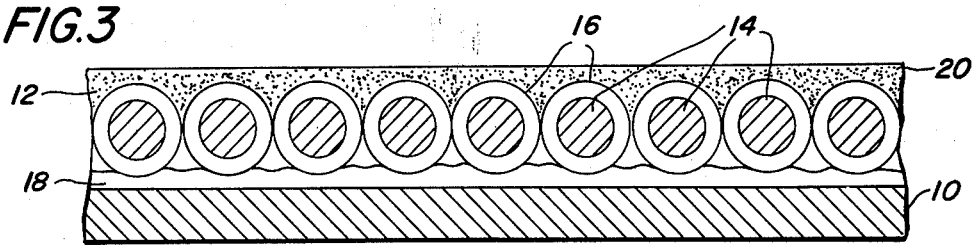

ELECTROSTATOGRAPHIC GRAVURE MEMBER

BACKGROUND OF THE INVENTION

One form of electrostatographic copying involves the use of a photosensitive member comprised of a conductive substrate having on its surface a layer of photoconductive material which is, in turn, overcoated with a layer of an insulating resin. This sort of photosensitive member is useful in the xerographic induction imaging process described by Butterfield in U.S. Pat. No. 2,693,416; Hall in U.S. Pat. No. 3,234,019; Mitsui in IEE Transactions on Electron Devices, April 1972 (Pp. 396–404); Nakamura in IEE Transactions on Electron Devices, April 1972 (Pp. 405–412) and Mark in Photographic Science and Engineering, May/June 1974 (Pp. 254–261).

In addition, a novel gravure imaging system is disclosed in U.S. Pat. No. 3,801,315. This system employs a gravure member having a conductive backing with a uniform pattern of lands and valleys thereon, the lands having a surface of a photoconductive insulating material. A liquid developing medium is applied to the valleys of the gravure member, leaving the land areas substantially clean. After application of the developing liquid, the gravure member is uniformly charged and then exposed to a light and shadow image. Exposure of the charged surface discharges those areas which are irradiated and leaves the unexposed portions of the lands in the charged state to form a latent electrostatic image. The liquid developing material in the valleys is electrostatically attracted to the charged areas and will be caused to flow up to the charged areas of the lands by this electrostatic attraction to develop the latent image on the lands of the gravure member.

The gravure member, in a preferred embodiment, is a cylindrical surface with the lands and valleys on the surface in helicoid configuration. Such a member can be made by uniformly coating the cylindrical surface, which must be electrically conducting, with a layer of a photoconductive insulating material and then milling the cylinder to form valleys in the desired configuration. The milling operation will tend to remove the photoconductor from the milled areas thereby providing a gravure member with lands having a film of photoconductive material separated by valleys in which the conductive substrate is exposed. In the alternate embodiment, specifically disclosed in Example 6 of U.S. Pat. No. 3,801,315, the photoconductive material completely covers the surface of the gravure member. In this embodiment, in which it is necessary to use a developing medium which is opaque to the radiation used to image the member, a reversed or negative image is obtained. A gravure member useful in this embodiment could be prepared by applying a thin layer of photoconductive material to the cylindrical substrate after it has been milled to form the lands and valleys in helicoid configuration. In either case, fabrication of the gravure member presents problems because of the fine tolerances required during the milling operation.

It would be desirable and it is an object of the present invention to provide a novel electrostatographic photosensitive device which is useful in the above-described imaging methods.

It is an additional object to provide a novel photosensitive device comprising a substrate, which need not necessarily be conductive, and a layer of photoconductive material over said substrate which is, in turn, overcoated with a dielectric storage layer.

Another object is to provide a novel method for fabricating such a device.

A further object is to provide a novel gravure member for the previously described liquid developed copying method.

An additional object is to provide such a gravure member which can be readily fabricated to fine tolerances.

A further object is to provide such a gravure member in which the substrate need not necessarily be electrically conductive.

Another object is to provide a novel method for the preparation of such a gravure member.

SUMMARY OF THE INVENTION

The present invention is a photosensitive member useful in electrostatographic copying which comprises:

a. an endless, arcuate substrate; and b. a thin, conductive filament having a layer on its surface of a photoconductive insulating material, closely wrapped in helical configuration around said substrate with said conductive filament being connected to ground or a suitable bias source.

Also disclosed is a method for the preparation of the above-described photosensitive device.

DETAILED DESCRIPTION AND PREFERRED EMBODIMENTS

FIG. 1 is a schematic representation of a cross section (taken parallel to the axis of rotation of the arcuate substrate) of the photosensitive device of the present invention.

The device, which in this embodiment is useful as a gravure member, comprises a substrate 10 having on its surface a monolayer of coated filament 12 wrapped around the substrate in helical configuration. The coated filament comprises a core 14 of a conductive material uniformly coated with a layer of a photoconductive insulating material 16. Normally, the coated filament will be bonded to the substrate by a thin layer of adhesive material 18, part of which will tend to be extruded up into the spaces between the coated filaments during fabrication of the gravure member. A conductive adhesive such as, for example, Epo-tek H20 conductive epoxy manufactured by Epoxy Technology Inc., of Watertown, Mass., is preferred. In order to ground or bias the conductive filament, one or both ends are grounded or connected to a common power supply.

The filament diameter and thickness of the photoconductive coating are not critical and will be limited only by the practicalities of fabrication and the desired resolution of the system. In the case of a filament 1 mil in diameter with a ½ mil coating thickness, adjacent filaments can be laid on 2 mil center-center spacings (with a 2 mil pitch). This corresponds to a resolution limit on the order of 20 lp/mm, which is highly acceptable for conventional full size imaging purposes.

One of the advantages of the photosensitive device of the present invention is that the substrate 10 need not be electrically conductive. It may, therefore, be made up of materials possessing other desirable properties such as flexibility, ease of fabrication or low cost. In addition, the base 10 need not be seamless since any seam present will be covered by the filament wrap.

Examples of substrates include flexible Mylar, rubber and metal belts; cardboard, elastomer, metal, or plastic drums. Alternatively, a micro-porous polyurethane sleeve can be used when internal developer feed is desired.

Selection of the filament is not critical and may be determined by consideration of the electrical properties of its surface such as, for example, whether the filament will have a natural or fabricated oxide coating and mechanical properties such as flexibility, tensile strength and electrical stability of the filament under fabrication conditions. Examples of materials from which the conductive core filaments may be fabricated include steel, copper, nichrome and chromel wire or non-metallic materials such as metallized polyester or nylon monofilaments, as well as conductive fiber filled polyester filaments.

The filament may be coated by known techniques, in large batches or continuous operations, depending on the photoconductive material being employed. Typical photoconductive filament coatings suitable for use in the invention include photoconductive lacquers and enamels, such as phthalocyanine, selenium, CdS/Se in a binder or 2,4,7-trinitro-9-fluorenone in poly(vinylcarbazole). Relatively adhesive binders such as silicone rubber, Viton A and fluoro-modified epoxies are especially desirable due to the ease with which they may be cleaned.

One method of preparing the photosensitive device of this invention is schematically illustrated by FIG. 2. In this figure, filament 12 is depicted as entering the U shaped coating material vessel 32 from filament source, not shown. The filament enters the vessel through entry orifice 34 and is immersed in the viscous coating solution 16. The coating solution is, for example, a dispersion of submicron size particles of X-metal free phthalocyanine in Lexan polycarbonate resin in a 1:6 weight ratio dispersed in sufficient methylene chloride solvent to provide a viscosity of about 50 cps. The filament proceeds through the solution and exits the vessel through exit orifice 38 whose configuration determines the coating thickness. The coated filament is dried by passage through drying chamber 41 which is supported by a support member, not shown. The coated filament is next wrapped around a cylindrical substrate 10 which has a thin layer of a conductive adhesive 18 on its surface. Vent 42 is provided to ensure the maintenance of a proper level of the coating material in the vessel during the coating operation. Typically, a closely spaced monolayer of coated filament is wrapped around the substrate although additional filament layers can be used especially in the embodiment in which the filaments are overcoated with a dielectric storage layer.

In the embodiment depicted in FIG. 2, the substrate is illustrated as being cylindrical in configuration. Alternatively, an endless belt, supported for example by a tri-roller setup, can be employed since the only critical requirement is that the substrate be endless and generally arcuate.

The photoreceptor may be used as a sleeve over a suitable mandrel, tracked as a belt or cut open after fabrication and used as a flat plate.

In an important modification of the photoreceptor of the present invention, the wire sleeve structure may be overcoated by a dielectric storage layer, such as a laminated or sprayed-on layer of 1 mil thick Mylar polyester sheet or a film of Lexan polycarbonate. Such structures may then be used, for example, for the xerographic induction imaging processes described in the references set out above. This embodiment is depicted in FIG. 3 wherein the filament layer is overcoated with a relatively thin layer of insulating resin 20. In FIG. 3 the dielectric storage layer may be smooth on its outer surface, although, if desired, the overcoating may be applied so that its exposed surface conforms with the filament pattern.

The method of practicing the present invention is more fully illustrated by the following examples.

EXAMPLE I

A 1000 ft. length of No. 40 AWG (3 mil cross section) nichrome wire is unwound from a supply spool, drawn through a conventional lacquering tank containing a photoconductive lacquer as specified below, stripped of excess enamel by passage through a concentrically mounted, sharp-edged circular orifice of 6 mil diameter, passed through a 120 ft. long drying channel maintained at about 70°C., and wound onto a 3 inch diameter receiving spool.

The lacquer composition comprises on a weight basis:

1 part poly(N-vinylcarbazole)
0.5 part 2,4,7,-trinitro-9-fluorenone
0.02 part of a sensitizing dye, Brilliant Green
5 parts of methylene chloride as solvent.

The wire passes through the tank at a rate of about 3 inches per second with the effective immersion distance being about 3 inches to provide an effective immersion time of about 1 second. The effective drying time is about 8 minutes. This procedure provides a uniform 0.45 mil thick dry film lacquer coating on the wire. An oxide layer or a thin dielectric enamel layer, < 0.1 mils and preferably less than 0.02 mils thick, may be applied to or be present on the wire to block injection of carriers into the photoconductive coating.

The photoconductive lacquered wire is subsequently spiral wound as a single layer of immediately touching coils onto a lathe-mounted photoreceptor drum blank. The blank consists of a 6 inch outside diameter, 0.25 inch thick, 11 inch long phenolic plastic cylinder shell, pre-coated with a 0.4 mil wet film of General Electric Co. RTV 108 (room temperature curable) silicone adhesive. When the desired working surface of the drum base is covered by the wire coil, the wire is secured in end-notches of the shell and cut. When the adhesive has cured, one or both of the ends of the wire are scraped bare and connected to a bias voltage supply or ground via conventional connector or commutator means. The finished photoreceptor may be used as the gravure member in the xerographic imaging process described by Gundlach et al. in U.S. Pat. No. 3,801,315.

EXAMPLES II – IV

The photoconductive lacquered wire described in Example I is wound on other experimental bases including:

Example II: An extruded aluminum tube of 3 inch outside diameter, ⅛ inch wall thickness and 11 inch axial length. The RTV 108 is again used as the adhesive.

Example III: A 65 inch circumference, 4.5 mil thick, 16.5 inch wide nickel sleeve mounted on a removable concentric core. The adhesive is a tacky solvent dispersion of the polycarbonate-polyurethane-copper phthalocyanine lacquer described by Angelini in U.S. Pat. No. 3,713,821.

Example IV: A 6 inch diameter, 3 mil thick, 3 inch wide seamless Mylar polyester belt. The preferred adhesive in this embodiment is Du Pont 49000 polyester adhesive in the form of a 0.5 mil thick tacky solvent dispersion in a 60:40 methyl ethyl ketone:toluene solvent.

The photoreceptors made using these bases may be mounted on suitable mandrels or belt tracking devices and used in the same fashion described in Example I. In Example III, the bared wire end or ends may be electrically connected to ground or a bias potential by way of the metal shell of the photoreceptor base.

EXAMPLE V

The fabrication process of Example IV is repeated with a different photoconductor lacquer composition based generally on the teachings of Byrne in U.S. Pat. No. 3,816,118. The composition comprises on a weight basis:

1 part of X-form of metal free phthalocyanine of particle size generally one micron or less 6 parts of Lexan 125 polycarbonate resin (General Electric Co.)

40 parts methylene chloride solvent.

The adhesive layer is a 0.5 mil thick wet film of Du Pont 49000 polyester dissolved in tetrahydrofuran as a saturated solution, containing in addition 15 percent (on a dry resin basis) of the X-form of metal free phthalocyanine. Thus, the adhesive is itself a photoconductive composition compatible with that of the wire coating.

From these examples, it can be determined that suitable materials for the substrate, wire, adhesive and photoconductive material may vary widely. Various means of wrapping and winding the photoconductor coated wire may be used, such means being generally known in the coil winding art. The photoconductive wire coating may be a soluble lacquer or a cross-linked enamel such as that taught in Examples 29–56 of the above-cited Byrne patent. In addition, the wire may be coated with vacuum-evaporated layers of photoconductive materials such as vitreous selenium by means of suitable modifications of known vacuum evaporation techniques.

The novelty of the invention lies in the fabrication and structure of the finished photoreceptor, i.e. a photoconductor coated wire is closely wrapped around a mandrel and then used in the form of a sleeve or flat sheet, optionally with a smooth dielectric overcoating. Obvious modifications of materials, fabrication techniques and uses will occur to those skilled in the art and it is my intention to be limited only by the scope of the following claims.

What is claimed is:

1. A photosensitive device for use in electrostatographic imaging which comprises:

a. an endless, arcuate substrate; and b. a thin, conductive filament, having a layer on its surface of a photoconductive insulating material, wrapped in helical configuration around said substrate wherein the filament is connected to ground or to a suitable bias source.

2. The photosensitive device of claim 1 wherein the conductive filament comprises steel, copper, nichrome or chromel.

3. The photosensitive device of claim 1 wherein the conductive filament comprises a metallized polyester or nylon monofilament.

4. The photosensitive device of claim 1 wherein the substrate is non-conductive.

5. The photosensitive device of claim 1 wherein the layer of photoconductive insulating material is a photoconductive lacquer or enamel.

6. The photosensitive device of claim 5 wherein the photoconductive layer is phthalocyanine, selenium, CdS/Se or 2,4,7-trinitro-9-fluorenone dispersed in poly(N-vinyl-carbazole).

7. The photosensitive device of claim 6 wherein phthalocyanine is dispersed in poly(N-vinylcarbazole).

8. The photosensitive device of claim 1 wherein the arcuate substrate is cylindrical in configuration.

9. The photosensitive device of claim 1 wherein the conductive filament layer is overcoated by a dielectric storage layer.

10. The photosensitive device of claim 9 wherein multiple layers of filament are wrapped around the substrate.

11. The photosensitive device of claim 1 wherein the conductive filament is nichrome wire, the photoconductive layer is poly(N-vinylcarbazole) containing 2,4,7-trinitro-9-fluorenone and Brilliant Green dye, and the substrate is a cylindrical shell of phenolic plastic.

12. The photosensitive device of claim 11 wherein the coated wire is cemented to the substrate with a silicone adhesive.

13. The photosensitive device of claim 1 wherein the photoconductive layer is the X-form of metal free phthalocyanine of particle size generally one micron or less dispersed in a polycarbonate resin.

14. The photosensitive device of claim 1 wherein the filament is wrapped around the substrate as a closely spaced monolayer.

* * * * *